US008066307B2

(12) United States Patent
Wahlström et al.

(10) Patent No.: US 8,066,307 B2
(45) Date of Patent: Nov. 29, 2011

(54) THREAD JOINT FOR A DRILL STRING FOR PERCUSSIVE ROCK-DRILLING

(75) Inventors: Patrik Wahlström, Fagersta (SE); Johan Ericson, Fagersta (SE)

(73) Assignee: Atlas Copco Secoroc AB, Fagersta (SE)

( * ) Notice: Subject to any disclaimer, the term of this patent is extended or adjusted under 35 U.S.C. 154(b) by 864 days.

(21) Appl. No.: 10/514,953

(22) PCT Filed: May 9, 2003

(86) PCT No.: PCT/SE03/00752

§ 371 (c)(1),
(2), (4) Date: Jan. 9, 2006

(87) PCT Pub. No.: WO03/097991

PCT Pub. Date: Nov. 27, 2003

(65) Prior Publication Data

US 2006/0118340 A1 Jun. 8, 2006

(30) Foreign Application Priority Data

May 22, 2002 (SE) ..... 0201530

(51) Int. Cl.
*F16L 15/00* (2006.01)

(52) U.S. Cl. ..... 285/334

(58) Field of Classification Search ..... 285/333, 285/334

See application file for complete search history.

(56) References Cited

U.S. PATENT DOCUMENTS

| | | | | | |
|---|---|---|---|---|---|
| 3,129,963 | A * | 4/1964 | Robbins | 285/334 |
| 3,645,570 | A * | 2/1972 | Johansson et al. | 285/334 |
| 3,717,368 | A * | 2/1973 | Czarnecki et al. | 403/343 |
| 4,687,368 | A * | 8/1987 | Eklof et al. | 285/334 |
| 5,169,183 | A * | 12/1992 | Hallez | 285/334 |
| H1329 | H * | 7/1994 | Bailey et al. | 285/334 |
| 6,030,004 | A * | 2/2000 | Schock et al. | 285/333 |
| 6,196,598 | B1 * | 3/2001 | Yao | 285/333 |
| 6,293,360 | B1 * | 9/2001 | Liljebrand et al. | 285/334 |
| 6,681,875 | B2 * | 1/2004 | Larsson et al. | 285/333 |
| 7,455,329 | B2 * | 11/2008 | Muradov et al. | 285/333 |
| 2002/0074797 | A1 | 6/2002 | Liljebrand et al. | |

FOREIGN PATENT DOCUMENTS

| | | |
|---|---|---|
| EP | 0979922 | 2/2000 |
| SE | 517151 | 4/2002 |
| WO | 0138686 A1 | 5/2001 |

OTHER PUBLICATIONS

V.M. Vasilyev, Perforators, Drills Manual, Nedra Publishers, Moscow, 1989.

N.D. Scherbyuk et al., Threaded Joints of Pipes for Oil Purposes and Bottom-Hole Motors, Nedra Publishers, Moscow, 1974.

* cited by examiner

*Primary Examiner* — David E Bochna
(74) *Attorney, Agent, or Firm* — Young & Thompson

(57) ABSTRACT

In percussion rock drilling a screw joint for a drill run or drill string including male and female screw threads (5, 9) on the elements (1, 2) are joined together to form a drill string. Within the screw joint the male thread (5) and the female thread (9) have a trapezoidal shape and a slight conical inclination.

7 Claims, 4 Drawing Sheets

THREAD JOINT FOR A DRILL STRING FOR PERCUSSIVE ROCK-DRILLING

CROSS-REFERENCE TO RELATED APPLICATIONS

The present application claims priority and incorporates by reference PCT/SE03/00752 filed May 9, 2003 and Swedish Patent Application 0201530-3 filed May 22, 2002.

STATEMENT REGARDING FEDERALLY SPONSORED RESEARCH OR DEVELOPMENT

None.

THE NAMES OF PARTIES TO A JOINT RESEARCH AGREEMENT

None.

INCORPORATION-BY-REFERENCE OF MATERIAL SUBMITTED ON A COMPACT DISC

None.

BACKGROUND OF THE INVENTION

1. Field of the Invention

The present invention relates to a screw joint for a drill run for percussion rock drilling.

2. Description of the Related Art

Screw joints of this nature are used to join together drill string elements, such as a drill bit, one or more drill strings and a shank adapter. The screw joints include mutually co-acting male and female screw threads where an external male thread on a component element is screwed to an internal female thread on a co-acting element, so as to join said elements together.

Swedish Patent Specification 515518 teaches a screw joint of the aforesaid kind in which the male and the female threads are conical and the tops and bottoms of the thread profiles have a radius of curvature that is greater than 30% of the thread pitch. Such a screw thread is referred to typically as a rope thread.

Although such a thread functions satisfactorily in the case of drill strings of more slender dimensions, problems occur as the dimensions of the drill strings increase, resulting in shortening of the useful life of the thread. This is mainly due to the tensile stresses acting on the internal thread, causing the screw joint to be tightened excessively, or over-tightened. In turn, this makes it difficult to loosen or disconnect the joint when drilling has been terminated or when fresh drill rods shall be connected up.

BRIEF SUMMARY OF THE INVENTION

Accordingly, an object of the present invention is to provide a novel screw joint with which the aforesaid problems are eliminated, so as to enable the novel screw joint to be used also with drill runs or strings of coarser dimensions.

This object is achieved with an inventive screw joint in which the male and female threads have a trapezoidal shape with a slight conical inclination.

BRIEF DESCRIPTION OF THE SEVERAL VIEWS OF THE DRAWINGS

The invention will now be described in more detail with reference to a non-limiting embodiment thereof, illustrated with the aid of the figures of the accompanying drawing, in which.

DETAILED DESCRIPTION OF THE INVENTION

Figure 1:
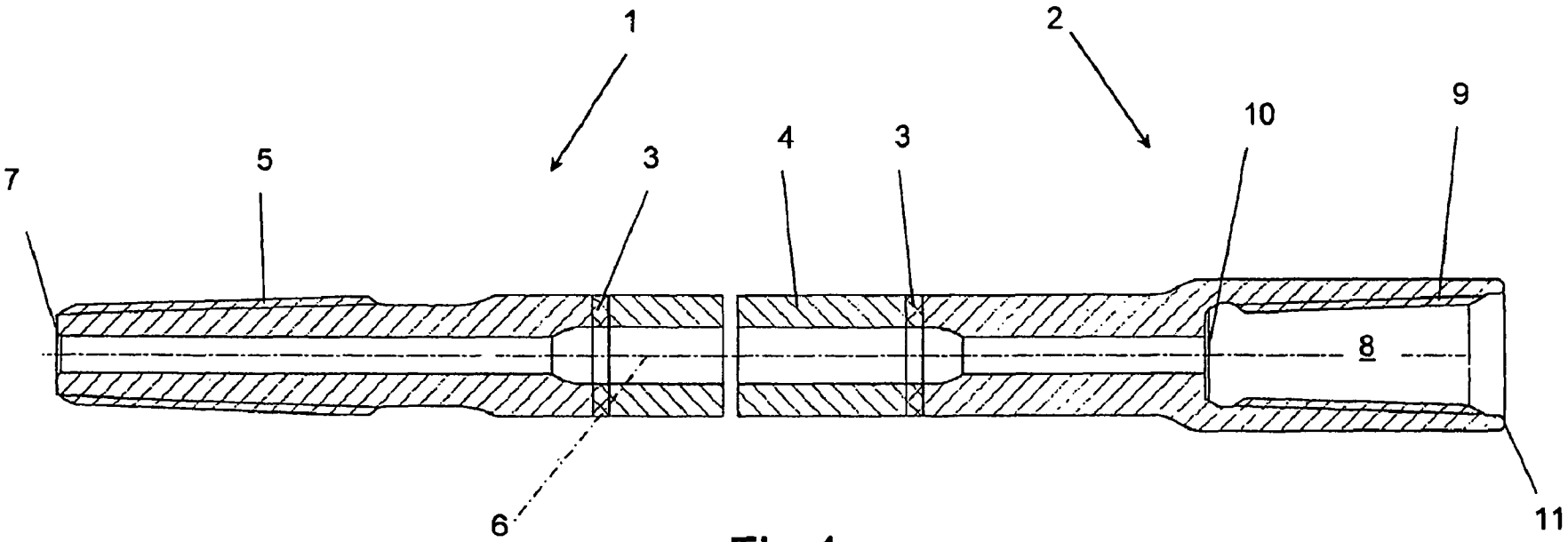
FIG. 1 is a schematic broken longitudinally sectioned view of a drill rod that has a male and a female end.

FIG. 1 is a broken longitudinally sectioned view of a drill rod, showing in particular both ends of the rod. The male end 1 and the female end 2 are connected, suitably welded at 3, to an intermediate element 4 so as to obtain an elongate drill rod. A drill rod of this kind may typically have a length of 6 meters. A drill string may consist of a number of such rods that have been screwed together with the aid of respective screw threads. As before mentioned, the drill string includes a drill bit at one end and a shank adapter at the other end, which are also joined to the drill rods by means of corresponding screw threads.

As will be seen from FIG. 1, the male end 1 is provided with an external screw thread or male thread 5. It will also be seen from the figure that the male thread is conical and is inclined towards the centre axis 6 (shown in chain lines) of the drill rod. The male end 1 has an end surface 7 that can be used as a stop surface, as described in more detail below. As will also be seen from the figure, the female end 2 includes an internally extending hole 8 in which the male end 1 of another drill rod can be received. The hole 8 has an internal thread, or female thread 9, which is intended to be screwed together with the male thread 5 of another element to be connected to the element carrying the female thread. The female thread is therefore also slightly conical and has the same angle of inclination as the centre axis 6 (shown in chain lines) of the drill rod. Located at the bottom of the hole 8 is an abutment surface against with the end surface 7 of the male part 1 can bottom when screwing two elements together.

As shown, the female part 2 may be provided at its free end with a generally cylindrical contact surface 11 that surrounds the mouth of the hole 8. The male part 1 may then be provided with a corresponding contact flange at a distance from the end of the male part that is shorter than the depth of the hole 8, so that the male and female parts will reach end positions as a result of the contact between the contact surface and the contact flange, instead of the end surface 7 of the male part coming into contact with the abutment surface 10 of the female part.

Figure 2:
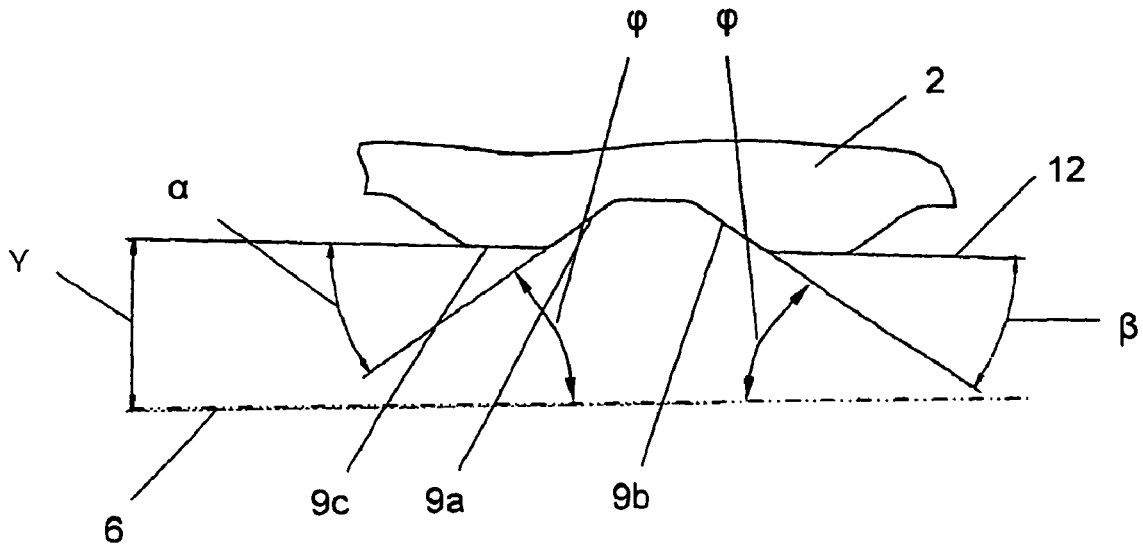
FIG. 2 shows part of the profile of an internal screw thread.

FIG. 2 shows part of an internal thread 9 of a female part 2. The flanks or edges 9*a*, 9*b* of the thread 9 define angles $\alpha$ and $\beta$, respectively, with the line 12 tangential to the apices 9*c* of the threads. The difference between the angles, $\alpha-\beta$, is equal to two times the angle $\gamma$ between the line 12 and the centre line 6. This means that the flanks 9*a*, 9*b* define the same angle $\phi$ in relation to the centre line 6. The flanks are also symmetrical with a straight central line between the flanks that also is perpendicular to the centre line 6.

Figure 4:
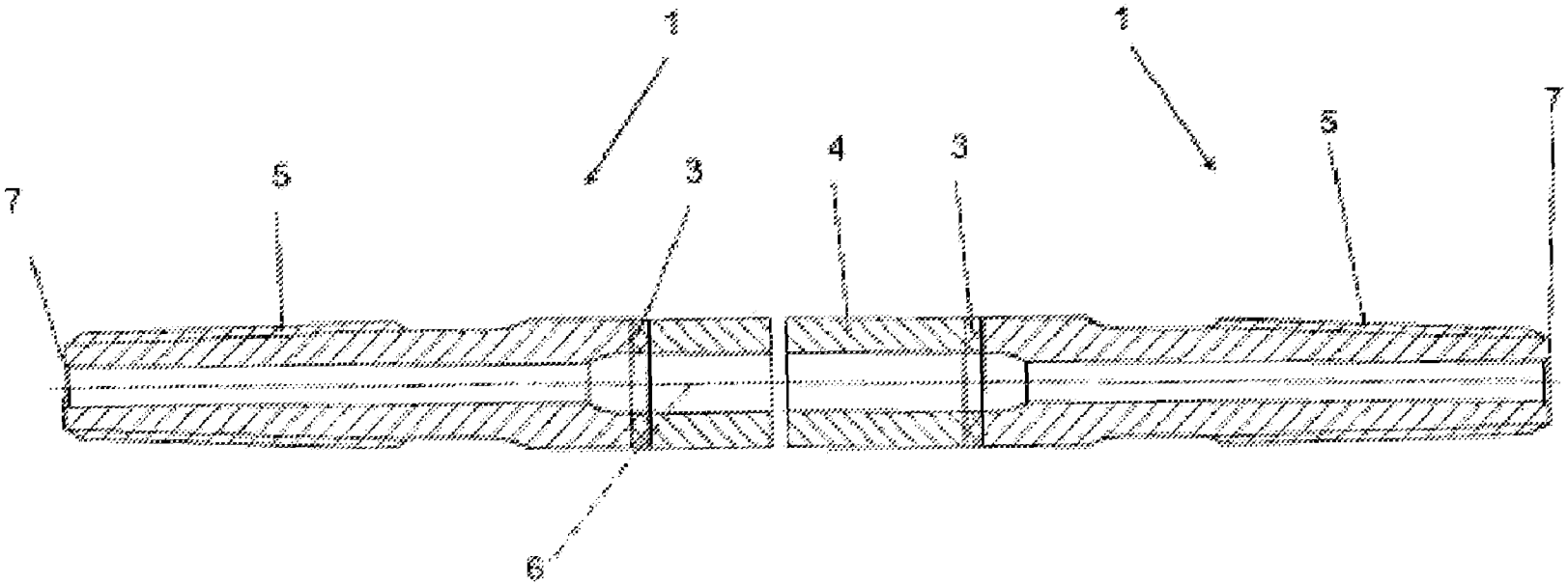
FIG. 4 is a schematic broken longitudinally sectioned view of a drill rod that has two male ends.
Figure 5:
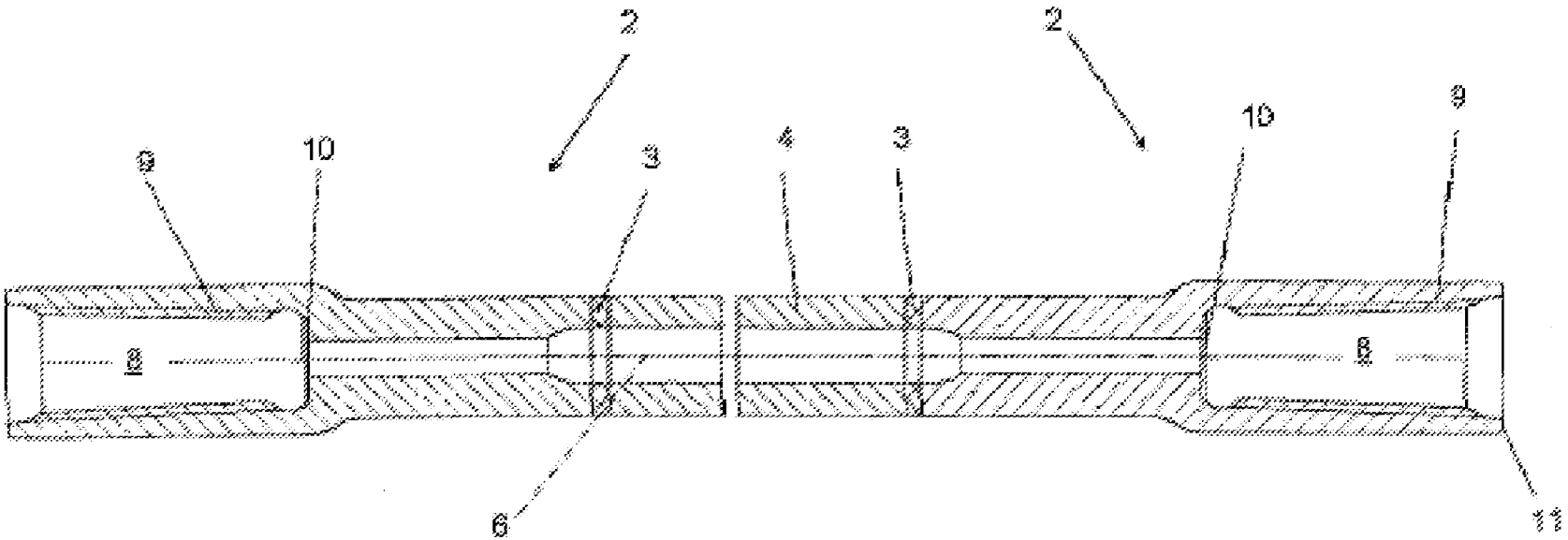
FIG. 5 is a schematic broken longitudinally sectioned view of a drill rod that has two female ends.

FIG. 4 is a drill road similar to FIG. 1 except that the male end 1 as in FIG. 1 is shown on both ends 1 of the drill rod. FIG. 5 shows the corresponding drill road with two female ends 2.

It is not necessary that the angles of the flanks to the centre line are exactly the same, but it is preferred that the flanks define essentially the same angle to the centre line 6.

Figure 3:
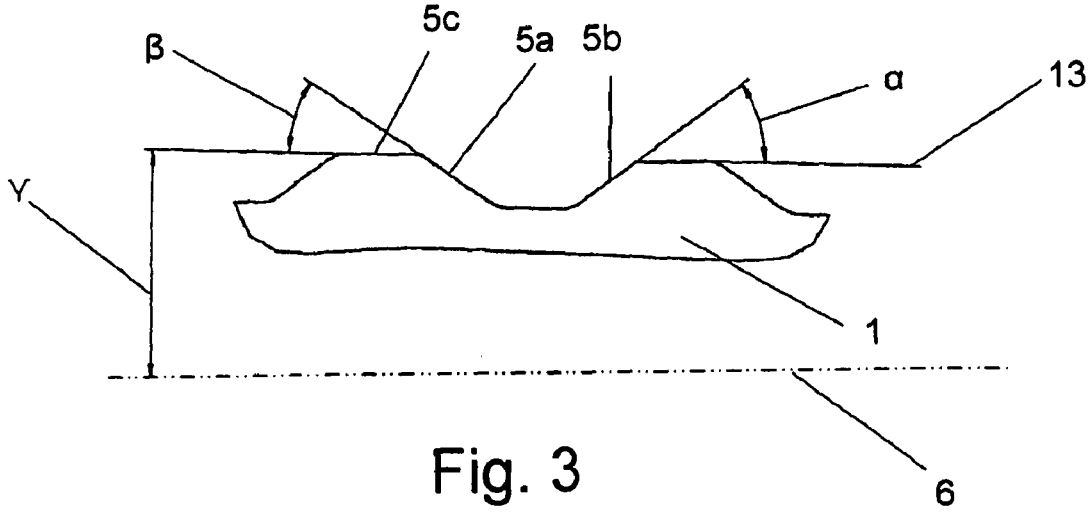
FIG. 3 shows a corresponding part of the profile of an external screw thread.

FIG. 3 shows a view similar to that shown in FIG. 2, but in this case showing a part of the outer thread 5 of a male part 1. Also this thread 5 defines flanks or edges 5*a* and 5*b*, that define angles β and α, respectively, with the line 13 tangential to the apices 5*c* of the threads. The difference between the angles, β−α, is equal to two times the angle γ between the line 13 and the centre line 6. This also means that the flanks 5*a*, 5*b* define the same angle in relation to the centre line 6 for the same reason as that mentioned above.

Dimensions for which the inventive screw joint is suited are preferably thread diameters in the order of about 38-80 mm. This corresponds to drill hole diameters in the order of 64-200 mm. However, the screw joint is not restricted to those dimensions, but can be used for both finer and coarser dimensions.

The thread flank angles α, β are smaller than 45°, preferably between 30 and 40°, in relation to the respective lines 12, 13 that are tangential to the apices of the flanks or edges of the thread. The cone angle is preferably smaller than 7°, preferably about 4°. With a cone angle of 4°, the angle γ in the figures will thus be 2°.

An inventive thread design reduces the risk of the drill string breaking under the bending stresses to which it is subjected in the drill hole. The conical configuration of the screw thread enables the material thickness to be increased in the inner parts of respective threads, with a corresponding reduction in the risk of a breakage or fracture occurring.

The screw joint according to the present invention can be readily unscrewed when the drill string or drill run is withdrawn from the drill hole, but is nevertheless sufficiently stable to ensure that the screw threads will not loosen in the hole.

As shown in the figures and described above, the screw joints are constructed so that the drill strings have a female thread at one end and a male thread at the other end. However, it will be understood that the inventive screw joint can also be used in conjunction with splicing sleeves, although screw joints that are fully integrated in the drill strings are preferred since this eliminates the risk of damage due to loosening splicing sleeves.

The invention claimed is:

1. A screw joint for a drill run or drill string for percussion rock drilling, comprising male and female screw threads (5, 9) on the elements (1, 2) to be joined together to form a drill string, wherein the male thread (5) and the female thread (9) have a trapezoidal shape and a slight conical inclination along the length of the threads, wherein the flanks of said threads define approximately a same angle with the centre line of the threads, wherein the flank angles (α, β) between the flanks of the threads and the line (13;12) that is tangential with the apices (5*c*;9*c*) of the threads (5;9) is smaller than 45°.

2. The screw joint according to claim 1, wherein the slight conical inclination along the length of the threads extends to the distal end of the male thread.

3. The screw joint according to claim 1, wherein a cone angle of the conical inclination is smaller than 7°.

4. The screw joint according to claim 3, wherein the cone angle is about 4°.

5. A drill rod for percussion rock drilling, wherein the drill rod in one end is provided with a male thread (5) and in its other end with a female thread (9), which male and female threads have a trapezoidal shape and a conical inclination along the length of the threads, wherein the flanks of said threads define approximately a same angle with the center line of the threads, wherein the flank angles (α, β) between the flanks of the threads and the line (13;12) that is tangential with the apices (5*c*;9*c*) of the threads (5;9) is smaller than 45°.

6. The drill rod according to claim 5, wherein a cone angle of the conical inclination is smaller than 7°.

7. The drill rod according to claim 6, wherein the cone angle of the threads is about 4°.

* * * * *